US007526216B2

(12) United States Patent
Shimokawa

(10) Patent No.: US 7,526,216 B2
(45) Date of Patent: Apr. 28, 2009

(54) FIXING DEVICE AND FIXING METHOD

(75) Inventor: Koji Shimokawa, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 336 days.

(21) Appl. No.: 11/560,025

(22) Filed: Nov. 15, 2006

(65) Prior Publication Data

US 2007/0166062 A1 Jul. 19, 2007

(30) Foreign Application Priority Data

Jan. 13, 2006 (JP) ..... 2006-006048
Oct. 31, 2006 (JP) ..... 2006-296265

(51) Int. Cl.
*G03G 15/20* (2006.01)

(52) U.S. Cl. ..... 399/33; 399/69

(58) Field of Classification Search ..... 399/69, 399/67, 94, 33; 219/216
See application file for complete search history.

(56) References Cited

U.S. PATENT DOCUMENTS 7,027,749 B2 * 4/2006 Kamei ..... 399/69
7,248,807 B2 * 7/2007 Oka et al. ..... 399/33
7,254,352 B2 * 8/2007 Lee ..... 399/69
7,412,181 B2 * 8/2008 Mulder et al. ..... 399/69
2005/0175367 A1 * 8/2005 Urabe ..... 399/69
2007/0196119 A1 * 8/2007 Fujita ..... 399/68
2007/0292155 A1 * 12/2007 Kida ..... 399/69

FOREIGN PATENT DOCUMENTS

JP 08-016030 1/1996
JP 2001-042678 2/2001
JP 2003-0438543 2/2003
JP 2005-274948 10/2005

* cited by examiner

*Primary Examiner*—Susan S Lee
(74) *Attorney, Agent, or Firm*—Amin, Turocy & Calvin, LLP

(57) ABSTRACT

A fixing device includes a first heater provided at a central part of a roller body in a longitudinal direction thereof and a second heater provided at the end of the roller body in the longitudinal direction thereof. A single thermostat is provided at a position where the difference between the first temperature when only the first heater lights and the second temperature when only the second heater lights is set within a predetermined range.

20 Claims, 4 Drawing Sheets

FIXING DEVICE AND FIXING METHOD

CROSS-REFERENCE TO RELATED APPLICATION

This application is based upon and claims the benefit of priority from the prior Japanese Patent Applications No. 2006-6048 filed on Jan. 13, 2006 and No. 2006-296265 filed on Oct. 31, 2006, the entire contents of which are incorporated herein by reference.

BACKGROUND

1. Field of the Invention

The present invention relates to a fixing device and a fixing method for fixing a toner image on a recording sheet.

2. Description of the Related Art

In Japanese Patent Application Publication No. 2005-274948, a fixing device including a heat roller having a heat generation surface for generating heat for heating a recording sheet by heat generated from the heat generation surface, a pressure roller for pressing the recording sheet to the heat generation surface of the heat roller, and a thermostat for stopping heat generation of the heat generation surface when the temperature at the monitoring portion where the peak of the temperature appears exceeds a predetermined threshold value in the second area of the heat generation surface of the heat roller excluding the first area where the recording sheet always makes contact with at time of press-fit by the pressure roller is disclosed.

Further, in Japanese Patent Application Publication No. 2003-43854, an image forming apparatus composed of a fixing device including a first heater arranged in the neighborhood of the central part of fixing rollers in the axial direction, a second heater arranged in the neighborhood of both ends thereof, a first temperature detecting means for detecting the temperature of the first heater having larger power than that of the second heater, and a second temperature detecting means for detecting the temperature of the second heater is disclosed.

To heat the central part and end parts of each recording sheet, separate heaters are used and to detect abnormal temperatures of the respective heaters, at least two thermostats are required. However, due to use of two thermostats, a problem arises that the whole cost of the copier is increased and no inexpensive products can be provided to users.

SUMMARY

An object of the present invention is to provide inexpensive fixing device and fixing method of an image forming apparatus using at least two heater lamps in which the number of thermostats is reduced.

According to an aspect of the present invention, there is provided a fixing device comprising a roller body; a first heater provided at a central part of the roller body in a longitudinal direction; a second heater provided at an end of the roller body in the longitudinal direction; and a single thermostat provided at a position where a difference between a first temperature when only the first heater acts and a second temperature when only the second heater acts is set within a predetermined range.

Furthermore, according to an aspect of the present invention, there is provided a fixing method comprising heating a central part of a roller body in a longitudinal direction; heating an end of the roller body in the longitudinal direction; and interrupting heating of the central part and the end of the roller body by a single power supply interruption member provided at a position where a difference between a first temperature when the central part is heated and a second temperature when the end is heated is set within a predetermined range when the heating temperature of the roller body exceeds a predetermined temperature.

DETAILED DESCRIPTION

Hereinafter, the fixing device relating to each of the embodiments of the present invention will be explained in detail with reference to the accompanying drawings.

Figure 1:
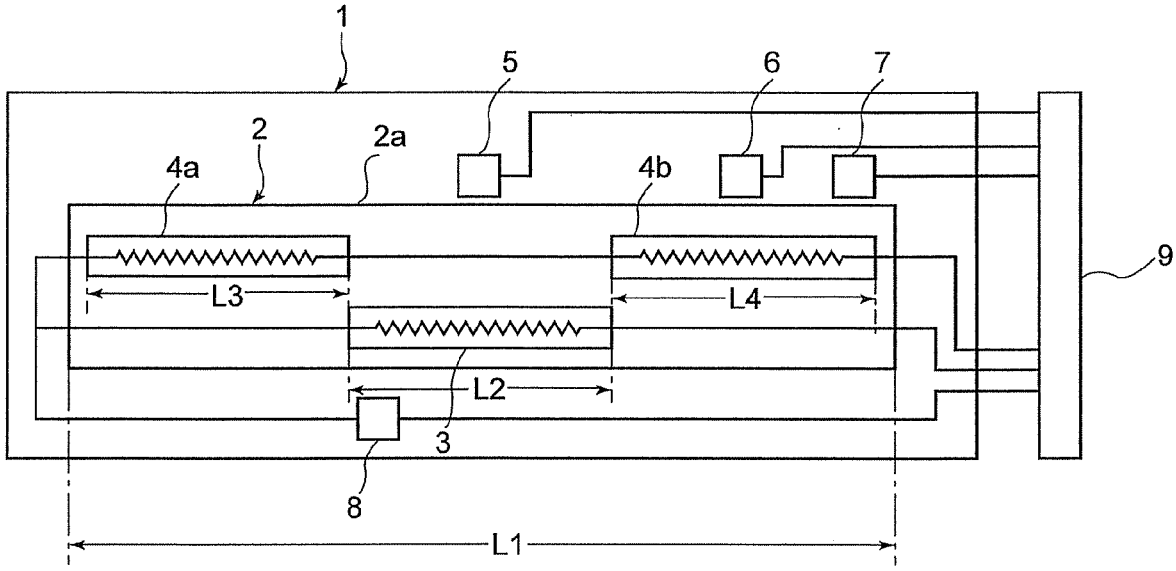
FIG. 1 is a schematic view showing the constitution of the fixing device relating to the first embodiment of the present invention.

A fixing device 1 shown in FIG. 1 fixes a transferred toner image on a recording sheet. Namely, by heat of a heat roller 2 driven to rotate and pressure of a pressure roller (not drawn) pressed to the heat roller 2, the toner image is fixed onto the recording sheet.

The fixing device 1 is composed of the heat roller 2 and a pressure roller (not drawn) pressed to the heat roller 2. The heat roller 2 is composed of a center heater lamp 3 as a first heater installed at the central part of a hollow cylindrical roller body 2*a* in the longitudinal direction and a side heater lamp 4*a* and a side heater lamp 4*b* as a second heater installed at both ends of the roller body 2*a* in the longitudinal direction. The side heater lamp 4*a* and side heater lamp 4*b* are electrically connected to each other in series. The center heater lamp 3 is connected to the side heater lamp 4*a* and side heater lamp 4*b* in parallel and they are controlled so as to light separately from each other. Namely, when fixing a narrow sheet, only the center heat lamp 3 is lit and when fixing a wide sheet, the center heater lamp 3 and side heater lamps 4*a* and 4*b* are lit.

To control the temperature of the heat roller 2, a center thermistor 5 for detecting the temperature in the neighborhood of the center heater lamp 3, a side thermistor 6 for detecting the temperature in the neighborhood of the side heater lamp 4*b*, and an edge thermistor 7 for detecting the temperature in the portion through which no recording sheets pass are arranged in the neighborhood of the outer peripheral surface of the roller body 2*a*. When the heater lamps 3, 4*a*, and 4*b* are kept on due to errors of the thermistors 5, 6, and 7 and an error of the power source, a thermostat 8 is installed in the neighborhood of the heat roller 2 so as to interrupt power supply.

Furthermore, so as to control the center heater lamp 3 and side heater lamps 4*a* and 4*b* to light on the basis of the detected temperatures of the center thermistor 5, side thermistor 6, and edge thermistor 7, a temperature controller 9 is installed.

Figure 2:
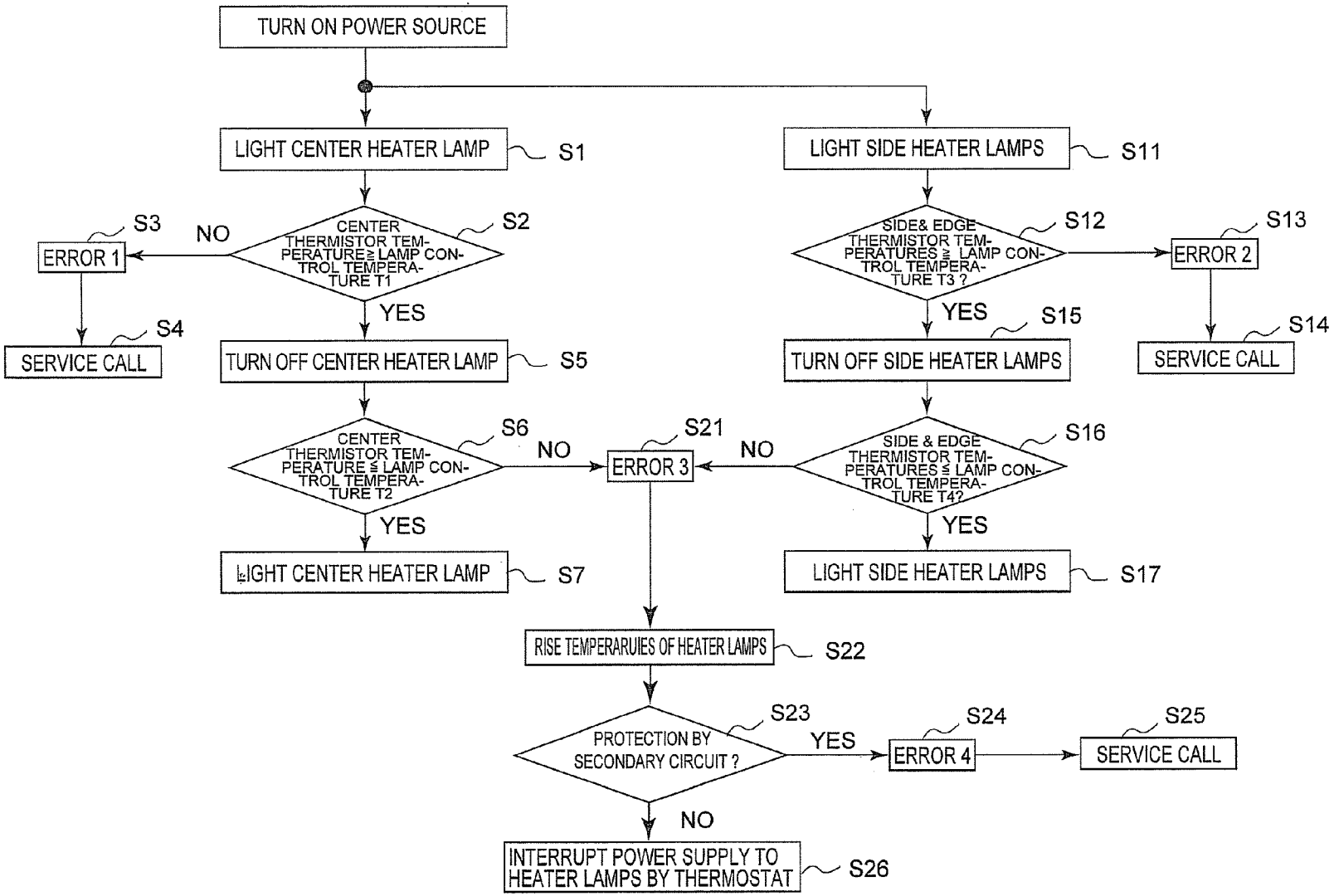
FIG. 2 is a flow chart showing the temperature control operation of the fixing device relating to the first embodiment of the present invention.

Next, the temperature control operations of the heater lamps 3, 4*a*, and 4*b* by the temperature controller 9 will be explained by referring to the flow chart shown in FIG. 2. Further, in FIG. 2, a lamp control temperature T1 indicates a temperature for lighting the center heater lamp 3, a lamp control temperature T2 a temperature for turning off the center heater lamp 3, a lamp control temperature T3 a temperature for turning off the side heater lamps 4*a* and 4*b*, and a lamp control temperature T4 a temperature for lighting the side heater lamps 4*a* and 4*b*, and those temperatures are preset in the temperature controller 9.

After turning on the power source, the center heater lamp 3 and side heater lamps 4*a* and 4*b* are lit (Steps S1 and S11). Next, the center thermistor 5, side thermistor 6, and edge thermistor 7 detect the temperature at each portion of the heat roller 2. When the detected temperature by the center thermistor 5 is lower than the lamp control temperature T1 (NO at Step S2) and the detected temperatures by the side thermistor 6 and edge thermistor 7 are lower than the lamp control temperature T3 (NO at Step S12), it is assumed that the center heater lamp 3 and side heater lamps 4*a* and 4*b* cannot be controlled to light and an error 1 and an error 2 are detected (Steps S3 and S13). When the error 1 or error 2 is detected, a user is notified of an error of the fixing device as a service call (Step S4 or S14).

When the detected temperature by the center thermistor 5 is the lamp control temperature T1 or higher (YES at Step S2) and the detected temperatures by the side thermistor 6 and edge thermistor 7 are the lamp control temperature T3 or higher (YES at Step S12), it is assumed that the lighting control for the center heater lamps 3, 4*a*, and 4*b* is executed normally and the center heater lamp 3 and side heater lamps 4*a* and 4*b* are turned off (Steps S5 and S15).

Next, similarly to the control operation aforementioned, when the detected temperature by the center thermistor 5 is the lamp control temperature T2 or lower (YES at Step S6) and the detected temperatures by the side thermistor 6 and edge thermistor 7 are the lamp control temperature T4 or lower (YES at Step S16), it is assumed that the turning-off control for the center heater lamp 3 and side heater lamps 4*a* and 4*b* is executed normally and the center heater lamp 3 and side heater lamps 4*a* and 4*b* are lit (Steps S7 and S17).

On the other hand, when the detected temperature by the center thermistor 5 is higher than the lamp control temperature T2 (NO at Step S6) and the detected temperatures by the side thermistor 6 and edge thermistor 7 are higher than the lamp control temperature T4 (NO at Step S16), the turning-off control for the center heater lamp 3 and side heater lamps 4*a* and 4*b* is not executed normally and an error 3 is detected (Step S21).

At this time, the center heater lamp 3 and side heater lamps 4*a* and 4*b* continuously rise in temperature (Step S22), so that the secondary circuit controls to turn off the center heater lamp 3 and side heater lamps 4*a* and 4*b*. At this time, if protection by the secondary circuit is possible (YES at Step S23), it turns off the center heater lamp 3 and side heater lamps 4*a* and 4*b*, detects an error 4 (Step S24), and notifies a user of an error of the fixing device 1 as a service call (Step S25).

On the other hand, if protection by the secondary circuit is impossible (NO at Step S23), before the lamps rise to an abnormal temperature causing danger to a user, the thermostat 8 interrupts power supply to the center heater lamp 3 and side heater lamps 4*a* and 4*b* (Step S26).

In such temperature control by the heat roller 2, conventionally, to detect the temperature of the center heater lamp 3, one thermostat 8 is arranged in the neighborhood of the central position of the center heater lamp 4 and to detect the temperatures of the side heater lamps 4*a* and 4*b*, one thermostat 8 is arranged in the neighborhood of the central position of the side heater lamp 4*a* or 4*b*, that is, two thermostats are arranged. However, in this embodiment, the mounting condition of the thermostat 8 is found, thus only one thermostat 8 is arranged.

Hereinafter, the mounting condition of the thermostat 8 onto the fixing apparatus will be explained. As a mounting condition of the thermostat 8, it is important that no difference is generated between the detected temperatures by the thermostat 8 depending on the lighting condition of the heater lamps 3, 4*a*, and 4*b*. As a lighting condition of the heater lamps 3, 4*a*, and 4*b*, there are the following two conditions available under the control by the thermistors 5 to 7.

(a) Only the center heater lamp 3 lights.

(b) Only the side heater lamps 4*a* and 4*b* light.

When the heater lamps are kept on due to an error of the thermistors or an error of the power source, there is a case that the condition that the heater lamps light under the three conditions aforementioned is continued. As it is understood from the temperature distribution between the center and the sides of the heat roller 2 depending on the lighting condition of the heat lamps shown in the graphs in FIG. 3 according to the respective conditions, differences are generated between the temperatures at the respective portions of the heat roller 2. Therefore, when the heater lamps are kept on under each of the two conditions aforementioned, great differences are generated between the temperatures at the respective portions.

Figure 3:
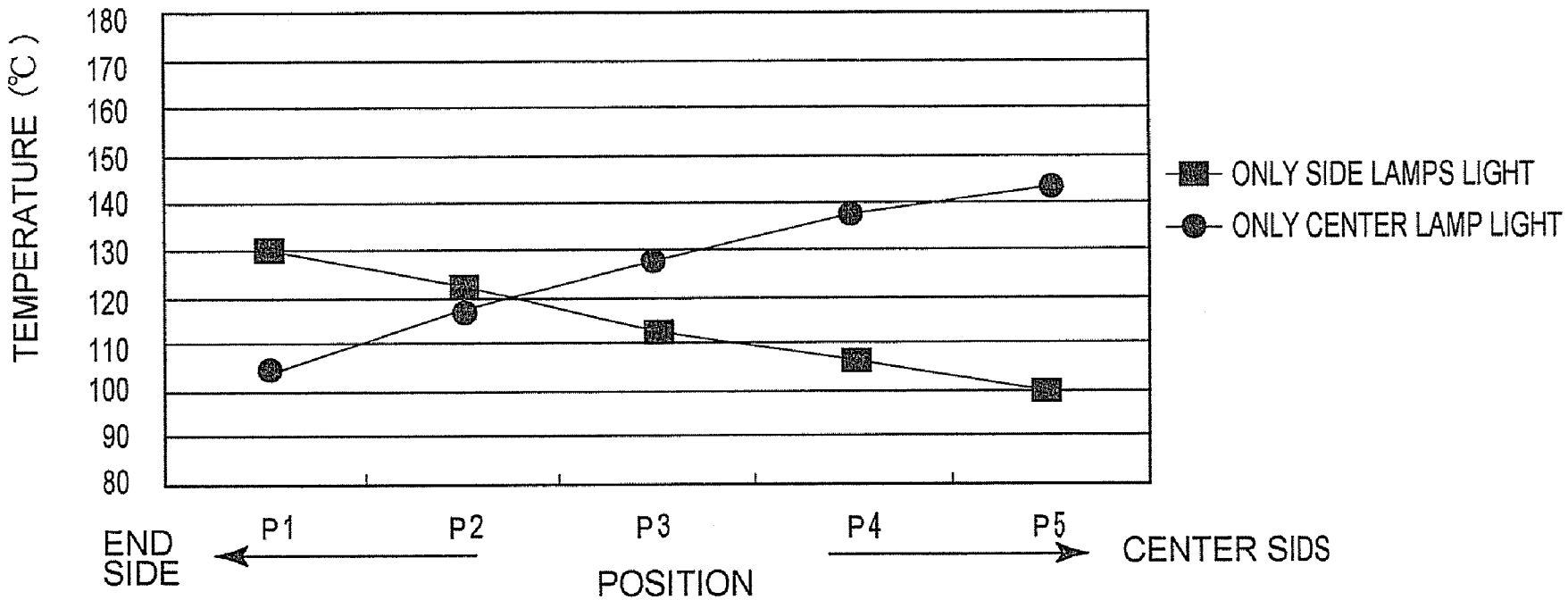
FIG. 3 is a graph for explaining the temperature distribution between the central part and the end of the heat roller depending on the lighting condition of the heater.

For example, in FIG. 3, if the thermostat 8 is arranged at a position P1 close to the end side, when only the side heater lamps 4*a* and 4*b* are kept on, the position where the temperature rises most rapidly is the position P1, so that an abnormal temperature is detected and the power supply can be interrupted by the thermostat 8. However, when only the center heater lamp 3 is kept on, at the position P1, the temperature rises most slowly. Therefore, when the power supply is interrupted by the thermostat 8, a position P5 already reaches the abnormal temperature and there is a fear that it may lead to ignition of a recording sheet.

Similarly, if the thermostat 8 is arranged at the position P5 close to the center, when only the center heater lamp 3 is kept on, the position where the temperature rises most rapidly is the position P5, so that an abnormal temperature is detected and the power supply can be interrupted by the thermostat 8. However, when only the side heater lamps 4*a* and 4*b* are kept on, at the position P5, the temperature rises most slowly. Therefore, when the power supply is interrupted by the thermostat 8, the position P1 already reaches the abnormal temperature and there is a fear that it may lead to ignition of a recording sheet.

However, if the thermostat 8 is arranged at a position P2, when only the side heater lamps 4*a* and 4*b* light and when only the center heater lamp 3 lights, the temperatures at the position P2 are almost equal. Therefore, the timings of interrupting power supply by the thermostat 8 are almost the same. Therefore, when the thermostat 8 is arranged at the position P2, also in the aforementioned lighting pattern, an abnormal temperature can be detected. At this time, the difference between the temperature at the position P2 when only the center heater lamp 3 lights and the temperature at the position P2 when only the side heater lamps 4*a* and 4*b* light which are detected by the thermostat 8 is set to a desired value within the tolerance in consideration of variations in the temperatures of the center heater lamp 3 and side heater lamps 4*a* and 4*b* and prevention of ignition of a recording sheet.

As shown in FIG. 1, the roller body 2*a* has a cylindrical shape, for example, with a length L1 of 37.2 cm and a diameter of 3 cm. A length L2 of the center heater lamp 3 arranged in the roller body 2*a* is 20 cm and a tungsten halogen lamp is used. Lengths L3 and L4 of the side heater lamps 4*a* and 4*b* are 7 cm and a tungsten halogen lamp is used similarly. Further, P1 shown in FIG. 3 is positioned at a distance of 10 cm from the center of the center heater lamp 3 toward the end thereof in the longitudinal direction of the roller body 2 and P2 is positioned at a distance of 9 cm from the center of the center heater lamp 3 toward the end thereof. Further, P1 to P5 shown in FIG. 3 are respectively positioned at intervals of 1 cm.

The thermostat 8 has the position P2 at a distance of 9.17 cm from one end of the roller body 2*a* and is arranged in the neighborhood of the surface of the roller body 2*a*. As shown in FIG. 3, when only the side heater lamp 4*a* lights and the heating temperature is increased to 122° C., only the center heater lamp 3 lights and the heating temperature is increased to 116° C. and at the position P2, the temperature difference falls within the tolerance of 6° C. Namely, the position P2 is suited to a position where the thermostat 8 is to be arranged. If the thermostat 8 is arranged at a position where the temperature difference is within the tolerance of 6° C., even if only the center heater lamp 3, or only the side heater lamps 4*a* and 4*b*, or both of them light and are overheated, the single thermostat 8 can interrupt power supply and ignition of a recording sheet can be prevented.

Therefore, according to the first embodiment, when any one of the heater lamps 3, 4*a*, and 4*b* arranged at the ends and central part of the heat roller 2 lights, at a position where the temperature difference detected by the thermostat 8 becomes a desired value within the tolerance, the thermostat 8 is arranged. By doing this, the number of thermostats is reduced to one, and the assembly man-hour and number of parts are reduced, thus an inexpensive fixing device and an inexpensive image forming apparatus can be provided to users. In the embodiment aforementioned, the desired tolerance is set at 6° C. However, from the viewpoint of prevention of ignition of a recording sheet, if the temperature difference is 20° C. or lower, it may be said that it is a desired tolerance.

Figure 4:
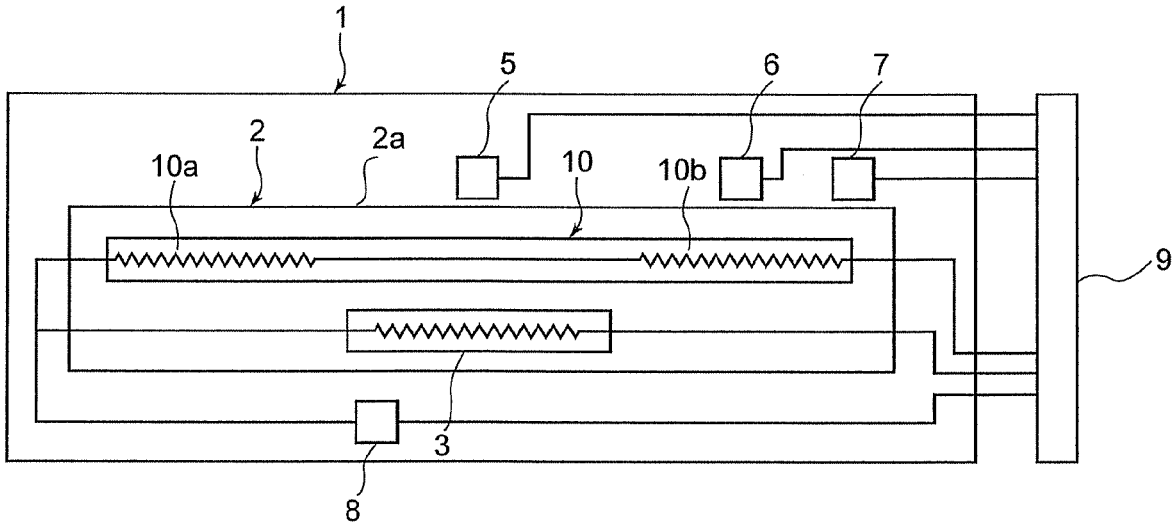
FIG. 4 is a schematic view showing the constitution of the fixing device relating to the second embodiment of the present invention.

According to the second embodiment, as shown in FIG. 4, a side heater lamp 10 composed of a filament 10*a* arranged at one end of a long tube and a filament 10*b* arranged at the other end thereof may be used. Further, to the same parts as those of the first embodiment, the same reference numerals are assigned and the explanation of the operations will be omitted.

Figure 5:
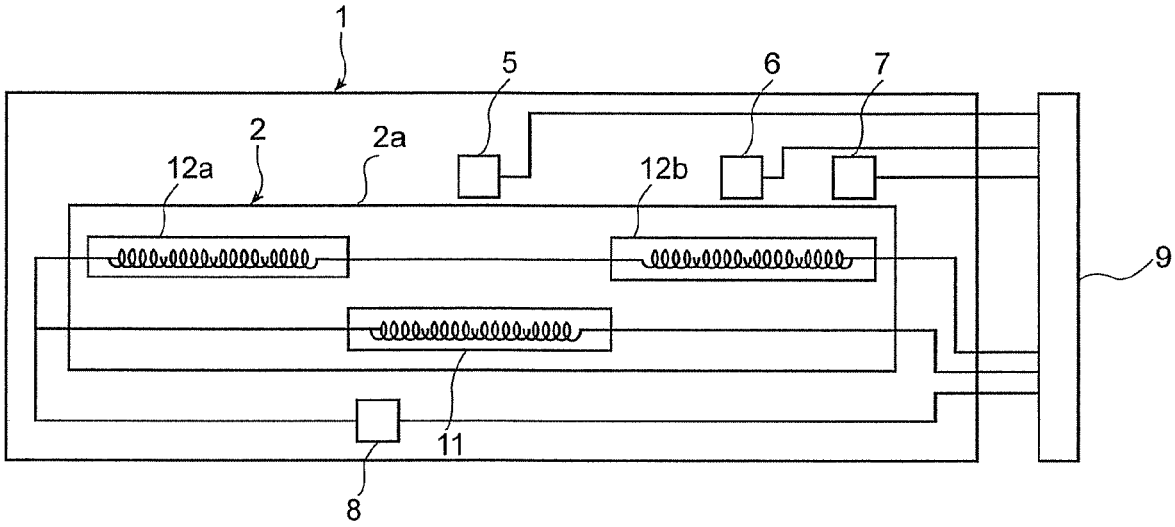
FIG. 5 is a schematic view showing the constitution of the fixing device relating to the third embodiment of the present invention.

Furthermore, according to the third embodiment, as shown in FIG. 5, in place of the heater lamps used in the first embodiment, exciting coils 11, 12*a*, and 12*b* for executing electromagnetic induction heating may be arranged inside the roller body 2*a*. Further, to the same parts as those of the first embodiment, the same reference numerals are assigned and the explanation of the operations will be omitted.

Also in the second and third embodiments aforementioned, similarly to the first embodiment, it is desirable to regulate the temperature distribution of the heaters so as to make the detected temperatures by the thermostat 8 equal to each other and arrange the thermostat 8, when the heaters light individually, at a position where the temperature difference detected by the thermostat 8 becomes a value within a desired tolerance.

What is claimed is:

1. A fixing device comprising:

a roller body;

a first heater provided at a central part of the roller body in a longitudinal direction;

a second heater provided at an end of the roller body in the longitudinal direction; and a single thermostat provided at a position where a difference between a first temperature when only the first heater acts and a second temperature when only the second heater acts is set within a predetermined range.

2. The fixing device according to claim 1, wherein the predetermined range is lower than 20° C.

3. The fixing device according to claim 1, wherein the thermostat is provided at a position where the first temperature and the second temperature coincide with each other.

4. The fixing device according to claim 1, wherein the first heater is a lamp and the second heater is a lamp.

5. The fixing device according to claim 1, wherein the second heater is a first and a second filament provided at both internal ends of one lamp.

6. The fixing device according to claim 1, wherein the first and the second heater are respectively exciting coils for executing electromagnetic induction heating.

7. A fixing device comprising:

first heating means for heating a central part of a roller body in a longitudinal direction;

second heating means for heating an end of the roller body in the longitudinal direction; and interruption means, installed at a position where a difference between a first temperature when only the first heating means heats and a second temperature when only the second heating means heats is set within a predetermined range, for interrupting a power supply to each of the first and second heating means.

8. The fixing device according to claim 7, wherein the predetermined range is lower than 20° C.

9. The fixing device according to claim 7, wherein the interruption means is provided at a position where the first temperature and the second temperature coincide with each other.

10. The fixing device according to claim 7, wherein the interruption means is a thermostat.

11. The fixing device according to claim 7, wherein the first heating means is a lamp and the second heating means is a lamp.

12. The fixing device according to claim 7, Wherein the second heating means is a first and a second filament provided at both internal ends of one lamp.

13. The fixing device according to claim 7, wherein the first and the second heating means are respectively heating coils of an electromagnetic induction type.

14. A fixing method comprising:

heating a central part of a roller body in a longitudinal direction;

heating an end of the roller body in the longitudinal direction; and interrupting heating of the central part and the end of the roller body by a single power supply interruption member provided at a position where a difference between a first temperature when the central part is heated and a second temperature when the end is heated is set within a predetermined range when the heating temperature of the roller body exceeds a predetermined temperature.

15. The fixing method according to claim 14, wherein the power supply interruption member is a thermostat.

16. The fixing method according to claim 14, wherein the heating the central part is a lamp and the heating the end is a lamp.

17. The fixing method according to claim 14, wherein the heating the end is a first and a second filament provided at both internal ends of one lamp.

18. The fixing method according to claim 14, wherein the heating the center and end in the longitudinal direction are respectively heating coils of an electromagnetic induction type.

19. The fixing method according to claim 14, wherein the predetermined range is lower than 20° C.

20. The fixing method according to claim 17, wherein the power supply interruption member is provided at a position where the first temperature and the second temperature coincide with each other.

* * * * *